US009370076B2

(12) United States Patent
Seo

(10) Patent No.: US 9,370,076 B2
(45) Date of Patent: Jun. 14, 2016

(54) METHOD FOR CONTROLLING DISPLAY POWER SUPPLY OF TERMINAL AND TERMINAL FOR PERFORMING THE METHOD

(71) Applicant: RSUPPORT Co., Ltd., Seoul (KR)

(72) Inventor: Hyung Su Seo, Gyeonggi-do (KR)

(73) Assignee: RSUPPORT Co., Ltd., Seoul (KR)

( * ) Notice: Subject to any disclaimer, the term of this patent is extended or adjusted under 35 U.S.C. 154(b) by 504 days.

(21) Appl. No.: 13/906,253

(22) Filed: May 30, 2013

(65) Prior Publication Data

US 2013/0320886 A1 Dec. 5, 2013

(30) Foreign Application Priority Data

May 31, 2012 (KR) ..... 10-2012-0058331

(51) Int. Cl.
*H05B 37/02* (2006.01)
*G09G 3/00* (2006.01)

(52) U.S. Cl.
CPC ..... *H05B 37/02* (2013.01); *G09G 3/00* (2013.01); *G09G 2330/022* (2013.01); *G09G 2330/026* (2013.01); *G09G 2330/027* (2013.01)

(58) Field of Classification Search
CPC ..... G09G 2330/022; G09G 2330/026; G09G 2330/027; G09G 3/00; H03K 17/288; H05B 33/0818; H05B 37/02; H05B 37/0227; H05B 37/0281; Y02B 20/42; Y02B 20/48
USPC ..... 315/360
See application file for complete search history.

(56) References Cited

U.S. PATENT DOCUMENTS 4,647,721 A * 3/1987 Busam ..... G06F 1/3209 379/102.04
2005/0073197 A1* 4/2005 Matsubara ..... B60R 25/209 307/10.5
2008/0120335 A1* 5/2008 Dolgoff ..... G05B 23/0216

FOREIGN PATENT DOCUMENTS

KP 10-2008-0070391 A 7/2008
KP 10-2010-0036041 A 4/2010

OTHER PUBLICATIONS

English Abstract for Korean Patent Application Publication No. 10-2010-0036041 A (2 pages).
English Abstract for Korean Patent Application Publication No. 10-2008-0070391 A (2 pages).

* cited by examiner

*Primary Examiner* — John Poos
*Assistant Examiner* — David Mattison
(74) *Attorney, Agent, or Firm* — Osha Liang LLP

(57) ABSTRACT

Provided are a method of controlling a power supply of a display unit of a terminal which can automatically restore the power supply of the display unit, and a terminal for performing the method. The method includes shutting off the power supply of the display unit within a preset time when a power supply shut-off event of the display unit occurs, and restoring the power supply of the display unit when a preset restoration condition is satisfied. Accordingly, even in a case in which a predetermined control application installed in the terminal is shut down due to unknown reasons, the power supply of the display unit may be automatically restored when a preset time arrives, thereby preventing the display unit from being continuously shut off.

9 Claims, 2 Drawing Sheets

METHOD FOR CONTROLLING DISPLAY POWER SUPPLY OF TERMINAL AND TERMINAL FOR PERFORMING THE METHOD

CLAIM FOR PRIORITY

This application claims priority to Korean Patent Application No. 10-2012-0058331 filed on May 31, 2012 in the Korean Intellectual Property Office (KIPO), the entire contents of which are hereby incorporated by reference.

BACKGROUND

1. Technical Field

Example embodiments of the present invention relate in general to terminal control, and more specifically, to a method of controlling a display unit so as to reduce battery consumption of a terminal, and a terminal for performing the method.

2. Related Art

When an information processing apparatus according to the related art remotely controls a terminal, an application of the terminal connected with a console software (control software) installed in the information processing apparatus may transmit signals for shutting off a power supply of a display unit of the terminal to the display unit while remotely controlling the terminal, and therefore battery life of the terminal may be extended.

In addition, the application of the terminal may transmit signals for restoring the power of the display unit to the display unit when it is determined that the remote control is terminated, and therefore the power of the display unit may be restored.

However, when the application of the terminal transmits the signals for shutting off the power supply of the display unit to the display unit and then is shut down abnormally, the signals for restoring the power of the display unit may not be transmitted, and therefore the power supply of the display unit may not be restored in such a state of being continuously shut off.

SUMMARY OF INVENTION

Accordingly, example embodiments of the present invention are provided to substantially obviate one or more problems due to limitations and disadvantages of the related art.

Example embodiments of the present invention provide a method of controlling a power supply of a display unit of a terminal, which may prevent power restoration errors of the display unit of the terminal while reducing battery consumption.

Example embodiments of the present invention also provide a terminal for performing the method of controlling the power of the display unit.

In some example embodiments, a method of controlling a power supply of a display unit of a terminal which is performed in the terminal includes: shutting off the power supply of the display unit within a preset time when a power supply shut-off event of the display unit occurs; and restoring the power supply of the display unit when a preset restoration condition is satisfied.

Here, the preset restoration condition may correspond to a case in which a task to be executed in response to the power supply shut-off event is terminated and the preset time arrives, or a case in which the preset time arrives.

Also, the shutting off of the power supply may include executing the task to be executed in response to the power supply shut-off event, and providing a shut-off control signal for indicating power supply shut-off of the display unit to the display unit.

Also, the restoring of the power supply may include repeatedly providing the shut-off control signal to the display unit for every preset time interval when the preset restoration condition is not satisfied.

Also, the power supply shut-off event may be a signal for remotely controlling the terminal.

In other example embodiments, a terminal includes: a display unit; and a control unit configured to shut off a power supply of the display unit based on a power supply shut-off signal of the display unit received from an installed control application, and restore the power supply of the display unit when a preset restoration condition is satisfied.

Here, the preset restoration condition may correspond to a case in which a task to be executed in response to the power supply shut-off signal is terminated and a preset time arrives, or a case in which the preset time arrives.

Also, the control unit may repeatedly provide a shut-off control signal to the display unit for every preset time interval when the preset restoration condition is not satisfied.

In still other example embodiments, a terminal includes: a display unit; a memory; and a processor configured to determine whether power supply shut-off of the display unit is needed by reading and executing a control application stored in the memory, shut off a power supply of the display unit when it is determined that the power supply shut-off of the display unit is needed based on a determination result, and restore the power supply of the display unit when a preset restoration condition is satisfied.

Here, the processor may repeatedly provide a shut-off control signal to the display unit for every preset time interval when the preset restoration condition is not satisfied.

BRIEF DESCRIPTION OF DRAWINGS

Example embodiments of the present invention will become more apparent by describing in detail example embodiments of the present invention with reference to the accompanying drawings, in which.

DESCRIPTION OF EXAMPLE EMBODIMENTS

Figure 1:
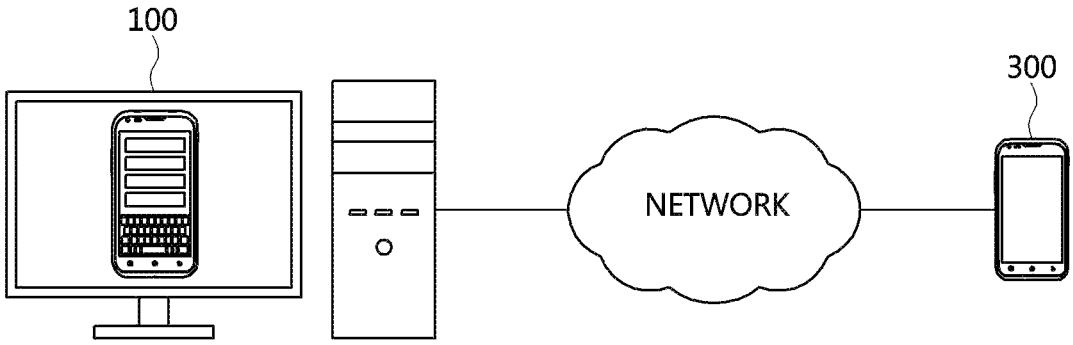
FIG. 1 is a diagram showing a configuration of a system of controlling a display unit according to an embodiment of the present invention.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Hereinafter, information processing apparatuses according to an embodiment of the present invention may include various digital information processing apparatuses such as laptop computers, palmtop computers, ultra mobile personal computers (UMPC), tablet PCs, personal digital assistants (PDA), web pads, mobile phones, and the like, as well as desktop computers, and perform a host function when connected with a terminal.

In addition, terminals according to an embodiment of the present invention may include mobile communication terminals such as smart phones, mobile phones, PDAs, and the like, and various digital information processing apparatuses such as portable multimedia players (PMP), smart players, pad-type terminals, and the like.

FIG. 1 is a diagram showing a configuration of a system of controlling a display unit according to an embodiment of the present invention.

Hereinafter, it is assumed that an information processing apparatus 100 and a terminal 300 are connected via a network such as a universal serial bus (USB), WiFi, Bluetooth, a mobile communication network 3G or 4G, or the like.

Referring to FIG. 1, the information processing apparatus 100 remotely controls the terminal 300, and a shape of the terminal 300 and an executed program are displayed on the information processing apparatus 100.

When the terminal 300 is remotely controlled from the information processing apparatus 100, the remote control starts and at the same time a power supply of a display (see, reference numeral 305 of FIG. 3) of the terminal 300 is shut off within a preset time, thereby preventing unnecessary battery consumption.

In addition, when it is determined that the preset time arrives, the terminal 300 automatically restores a power supply of the display (see, reference numeral 305 of FIG. 3) of the terminal 300.

Accordingly, the terminal 300 according to an embodiment of the present invention shuts off a power supply of the display unit (see, reference numeral 305 of FIG. 3) within a preset time and automatically restores the power supply of the display unit (see, reference numeral 305 of FIG. 3) in a hardware manner, thereby preventing the display unit (see, reference numeral 305 of FIG. 3) of the terminal 300 from causing a restoration error phenomenon.

Figure 2:
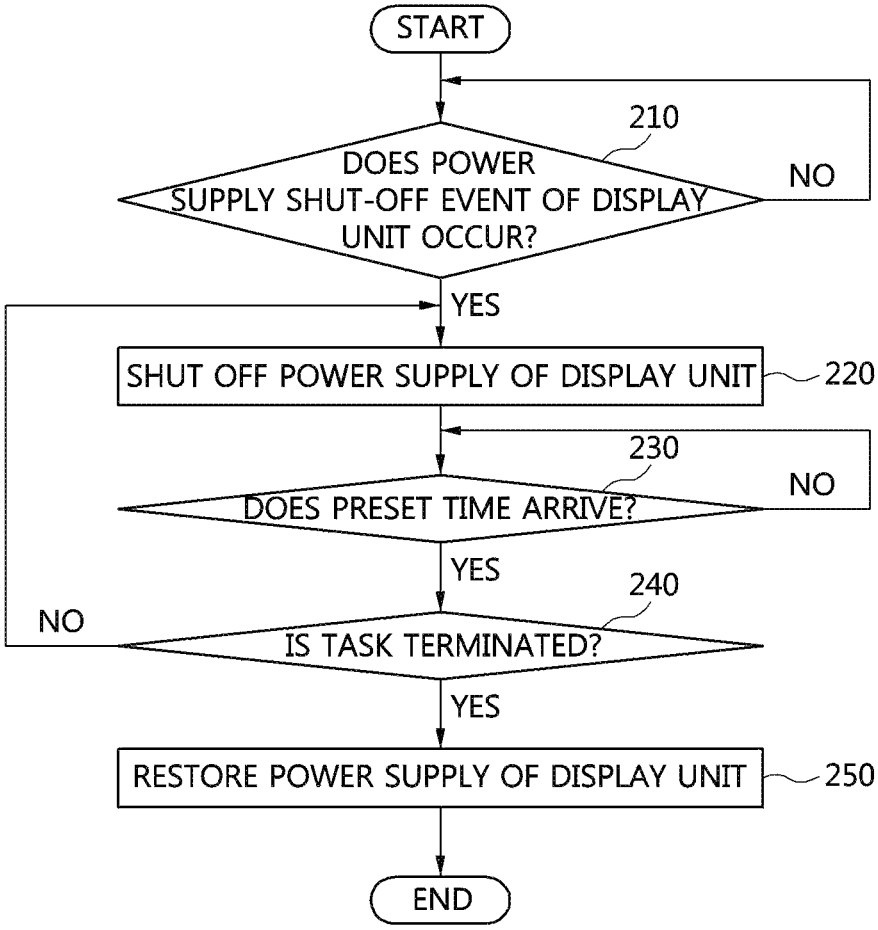
FIG. 2 is a flowchart showing a method of controlling a power supply of a display unit according to an embodiment of the present invention.

FIG. 2 is a flowchart showing a method of controlling a power supply of a display unit according to an embodiment of the present invention.

Referring to FIG. 2, in operation 210, a terminal determines whether an event to cause a power supply of a display unit to be shut off occurs.

For example, the event occurs when the terminal is not required to be operated or the display unit is not required to be in ON state.

Specifically, for example, when the terminal is remotely controlled, an information processing apparatus (see, reference numeral 100 of FIG. 1) that performs remote control displays a display screen of the terminal, and therefore the display unit of the terminal is not required to be in ON state. In this case, when the terminal is remotely controlled, battery consumption of the terminal may be reduced by turning off the display unit of the terminal.

Here, operation 210 may be performed depending on whether a control unit included in the terminal receives a power supply shut-off signal of the display unit from a control application installed in advance.

Here, the control unit may be constituted of an application programming interface (API) in the form of a system driver so as to be interlocked with a software operating system (OS), so that a general application may easily use the control unit.

In operation 220, when it is determined that the event to cause the power supply of the display unit to be shut off occurs through operation 210, the terminal starts to execute a task associated with the event, and at the same time, shuts off the power supply of the display unit. Here, the task may be associated with, for example, remote control.

Here, operation 220 may be performed in such a manner that the control unit receives the power supply shut-off signal of the display unit from the control application installed in advance, and shuts off the power supply of the display unit based on the received power supply shut-off signal of the display unit.

Next, in operation 230, the terminal determines whether a preset time arrives from a point of time when shutting off the power supply of the display unit.

In operation 240, when it is determined that the preset time arrives from the point of time when shutting off the power supply of the display unit through operation 230, the terminal determines whether the task currently executed is terminated.

Here, it is preferable that operation 240 be performed simultaneously with operation 230, or before the preset time of operation 230 arrives.

When it is determined that the task is not presently terminated through operation 240, the terminal returns to operation 220 to repeatedly perform operations starting from operation 220.

Alternatively, in operation 250, when it is determined that the task is presently terminated through operation 240, the terminal restores the power supply of the display unit.

Here, the display unit may refer to a display unit mounted in a terminal, and may be constituted of, for example, a thin film transistor (TFT) LCD module, an active matrix organic light-emitting diode (AM OLED) module, and the like.

Therefore, in the method of controlling the power supply of the display unit according to an embodiment of the present invention, even in a case in which software is shut down due to unknown reasons so that a power supply shut-off signal of the display unit or a power supply restoration signal of the control unit cannot be transmitted, the control unit may automatically restore a power supply to the display unit when the preset set time arrives.

Figure 3:
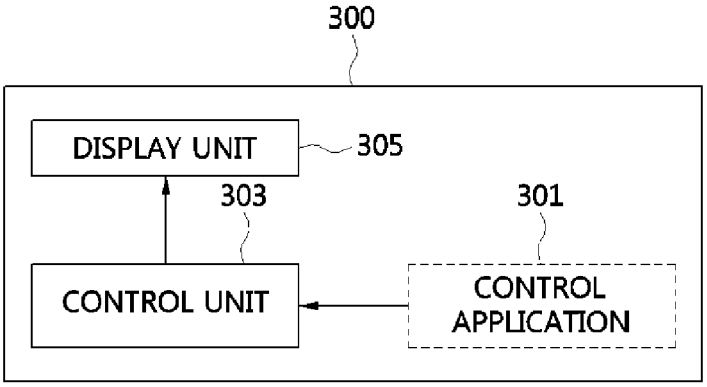
FIG. 3 is a block diagram showing a configuration of a terminal according to an embodiment of the present invention.

FIG. 3 is a block diagram showing a configuration of a terminal 300 according to an embodiment of the present invention.

Referring to FIG. 3, the terminal 300 according to an embodiment of the present invention may include a control application 301, a control unit 303, and a display unit 305.

The control application 301 installed in the terminal 300 may transmit a power supply shut-off signal of the display unit 305 or a power supply restoration signal of the display unit 305 to the control unit 303.

In addition, the control application 301 may transmit the power supply shut-off signal of the display unit 305 to the control unit 303, and then periodically transmit the power supply shut-off signal of the display unit 305 to the control unit 303 when it is determined that power supply shut-off of the display unit 305 is required to be maintained (for example, when the terminal 300 is remotely controlled, and the like).

The control unit 303 receives the power supply shut-off signal of the display unit 305 from the control application 301, and shuts off a power supply of the display unit 305 based on the received power supply shut-off signal of the display unit 305.

In addition, the control unit 303 determines whether a preset time arrives while shutting off the power supply of the display unit 305.

In addition, when it is determined that the preset time arrives, the control unit 303 determines whether the power supply shut-off signal of the display unit 305 is additionally received from the control application 301.

When it is determined that the power supply shut-off signal of the display unit 305 is additionally received from the control application 301, the control unit 303 shuts off the power supply of the display unit 305, and resets the preset time.

Next, the control unit 303 determines whether the reset time arrives, and shuts off or restores the power supply of the display unit 305 based on a determination result.

Alternatively, when it is determined that the power supply shut-off signal of the display unit 305 is not additionally received from the control application 301, the control unit 303 restores the power supply of the display unit 305.

Here, the control unit 303 may be constituted of an API in the form of a system driver so as to be interlocked with the control application 301, for example, a software OS, so that the control application 301 may easily use the control unit 303.

The display unit 305 may refer to a display unit mounted in a terminal, may be constituted of, for example, a TFT LCD module, an AM OLED module, or the like, and may be turned off or turned on in response to controls of the control unit.

Therefore, according to the terminal 300 that performs the method of controlling the power supply of the display unit according to an embodiment of the present invention, the control unit may automatically restore the power supply of the display unit when the preset time arrives, and prevent the display unit from being continuously shut off even when the control application is shut down due to unknown reasons so that the power supply restoration signal cannot be transmitted.

Figure 4:
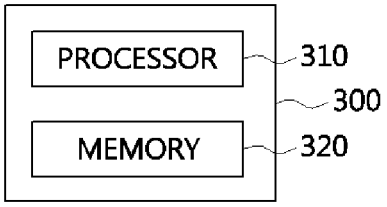
FIG. 4 is a diagram showing an example of an actual configuration of the terminal shown in FIG. 3.

FIG. 4 is a diagram showing an example of an actual configuration of the terminal shown in FIG. 3.

Referring to FIG. 4, the terminal 300 according to an embodiment of the present invention may include a processor 310 and a memory 320.

First, the processor 310 may substantially serve as the control application 301 and the control unit 303 shown in FIG. 3. That is, the processor 310 may determine whether power supply shut-off of the display unit 305 is needed by reading and executing the control application 301 stored in the memory 320, and shut off a power supply of the display unit 305 when it is determined that the power supply shut-off of the display unit 305 is needed based on a determination result.

In addition, the processor 310 may shut off the display unit 305, and then shut off a power supply of the display unit 305 and reset a preset time when it is determined that power supply shut-off of the display unit 305 is needed through the executed control application 301 within the preset time.

The control application 301 of FIG. 3 may be stored in the memory 320, and the memory 320 may be constituted of a non-volatile storage device such as a flash memory, ROM, a hard disk drive, or the like.

In addition, according to another embodiment of the present invention, the control unit 303 may be constituted of a separate hardware element, and restore the power supply of the display unit 305 in response to signals provided from the processor 310 when the preset time arrives.

According to the method of controlling the power supply of the display unit and the terminal for performing the method according to an embodiment of the present invention, when a power supply of the display unit is shut off, and then an event to shut off the power supply of the display unit does not occur until a preset time arrives, the power supply of the display unit may be automatically restored.

Therefore, even in a case in which a predetermined control application installed in a terminal is shut down abnormally, a power supply may be restored to the display unit when a preset time arrives, thereby preventing restoration errors of the display unit.

While the example embodiments of the present invention and their advantages have been described in detail, it should be understood that various changes, substitutions and alterations may be made herein without departing from the scope of the invention.

The invention claimed is:

1. A method of controlling a power supply of a display unit of a terminal, which is performed in the terminal, the method comprising:

shutting off the power supply of the display unit of the terminal within a preset time when a power supply shut-off event occurs; and restoring the power supply of the display unit of the terminal when a preset restoration condition is satisfied, wherein the terminal is remotely controlled by an information processing apparatus, wherein the information processing apparatus, when the terminal is remotely controlled and the power supply of the display unit of the terminal is shut off, displays a display screen of the display unit of the terminal on the information processing apparatus, and wherein the power supply shut-off event is a signal for remotely controlling the terminal.

2. The method of claim 1, wherein the preset restoration condition corresponds to a case in which a task to be executed in response to the power supply shut-off event is terminated and the preset time arrives, or a case in which the preset time arrives.

3. The method of claim 1, wherein the shutting off of the power supply includes executing the task to be executed in response to the power supply shut-off event, and providing a shut-off control signal for indicating power supply shut-off of the display unit to the display unit.

4. The method of claim 3, wherein the restoring of the power supply includes repeatedly providing the shut-off control signal to the display unit for every preset time interval when the preset restoration condition is not satisfied.

5. A terminal comprising:

a display unit; and a control unit configured to shut off a power supply of the display unit of the terminal based on a power supply shut-off signal received from an installed control application, and restore the power supply of the display unit of the terminal when a preset restoration condition is satisfied, wherein the terminal is remotely controlled by an information processing apparatus, wherein the information processing apparatus, when the terminal is remotely controlled and the power supply of the display unit of the terminal is shut off, displays a display screen of the display unit of the terminal on the information processing apparatus, and wherein the power supply shut-off event is a signal for remotely controlling the terminal.

6. The terminal of claim 5, wherein the preset restoration condition corresponds to a case in which a task to be executed in response to the power supply shut-off signal is terminated and a preset time arrives, or a case in which the preset time arrives.

7. The terminal of claim 5, wherein the control unit repeatedly provides a shut-off control signal to the display unit for every preset time interval when the preset restoration condition is not satisfied.

8. A terminal comprising:

a display unit;

a memory; and a processor configured to determine whether power supply shut-off of the display unit of the terminal is needed by reading and executing a control application stored in the memory, shut off a power supply of the display unit of the terminal when it is determined that the power supply shut-off of the display unit is needed based on a power supply shut-off event, and restore the power supply of the display unit of the terminal when a preset restoration condition is satisfied, wherein the terminal is remotely controlled by an information processing apparatus, wherein the information processing apparatus, when the terminal is remotely controlled and the power supply of the display unit of the terminal is shut off, displays a display screen of the display unit of the terminal on the information processing apparatus, and wherein the power supply shut-off event is a signal for remotely controlling the terminal.

9. The terminal of claim 8, wherein the processor repeatedly provides a shut-off control signal to the display unit for every preset time interval when the preset restoration condition is not satisfied.

* * * * *